United States Patent [19]

Wilson et al.

[11] 4,060,428

[45] Nov. 29, 1977

[54] PROCESS FOR FORMING FERROUS BILLETS INTO FINISHED PRODUCT

[75] Inventors: Norman A. Wilson, Shrewsbury, Mass.; Johann Grotepass, Rehweg, Germany

[73] Assignee: Morgan Construction Company, Worcester, Mass.

[21] Appl. No.: 710,023

[22] Filed: July 30, 1976

[51] Int. Cl.[2] ..... C21D 7/14

[52] U.S. Cl. ..... 148/12 R; 72/201; 72/364; 72/365; 148/12 B

[58] Field of Search ..... 148/12 R, 12 B, 12.4; 72/201, 364, 365

[56] References Cited

U.S. PATENT DOCUMENTS

| | | | |
|---|---|---|---|
| 2,756,169 | 7/1956 | Corson et al. | 148/12.4 |
| 3,231,432 | 1/1966 | McLean et al. | 148/12 B |
| 3,645,805 | 2/1972 | Hoffmann et al. | 148/12.4 |
| 3,933,534 | 1/1976 | Ettenreich et al. | 148/12 B |
| 3,939,015 | 2/1976 | Grange | 148/12 B |

*Primary Examiner*—W. Stallard

*Attorney, Agent, or Firm*—Thompson, Birch, Gauthier & Samuels

[57] ABSTRACT

A process for forming a ferrous billet into a finished product is disclosed comprising the following steps, in sequence: heating the billet to an appropriate elevated bulk temperature in preparation for rolling; hot rolling the heated billet to produce a semifinished product having an intermediate bulk temperature which is lower than said elevated bulk temperature; cooling the semifinished product to reduce the surface temperature thereof to a level below that of a desired finish rolling bulk temperature; allowing the temperatures of the surface and center portions of the semifinished product to equalize substantially to the level of the desired finish rolling bulk temperature; rolling the semifinished product to a finished product; and, cooling the finished product to an ambient bulk temperature.

9 Claims, 3 Drawing Figures

PROCESS FOR FORMING FERROUS BILLETS INTO FINISHED PRODUCT

DESCRIPTION OF THE INVENTION

Figure 1:
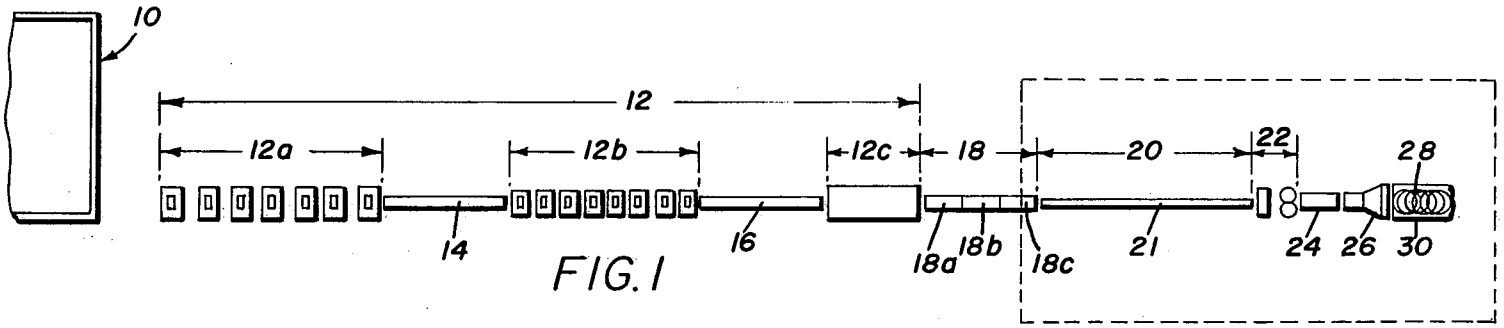

This invention relates generally to rolling mills, and is concerned in particular with a novel and improved process for rolling a ferrous billet into a finished product having improved yield strength.

The primary objective of the present invention is the provision of a process for producing ferrous rolled product having an improved yield strength, typically in the range of 75% of the product's ultimate strength. To this end, in its preferred form, the process of the present invention includes the following sequential steps: heating the billet to an appropriate elevated bulk temperature preferably above 2000° F; hot rolling the heated billet to produce a semifinished product having an intermediate bulk temperature below said elevated bulk temperature and preferably approximately in the range of 1700° F to 1900° F; cooling the semifinished product to reduce the surface temperature thereof to a level below that of a maximum finish rolling bulk temperature of approximately 1600° F; allowing the temperatures of the surface and center portions of the semifinished product to equalize substantially to the level of said finish rolling bulk temperature; rolling the semifinished product to a finished product; and, cooling the finished product to an ambient bulk temperature.

The cooling operation entails the direct application of a fluid coolant, for example water, to the surface of the semifinished product. Preferably, the semifinished product has a round cross-section to facilitate substantially uniform application of coolant to the surface thereof. Temperature equalization between the surface and center portions of the cooled semifinished product thereafter takes place as the semifinished product continues through guide pipes to a finish rolling station. The finish rolling station preferably includes at least two sets of work rolls, one set preferably being offset 90° relative to the other set. Typically, the first set of work rolls at the finishing station imparts an oval cross-section to the product, with the second and final set of work rolls imparting a finished round cross-section to the product. If desired, the final set of work rolls can be adapted to deform the surface of the finished product to produce concrete reinforcing bar, where maximum yield strength is of prime importance. After the finish rolling operation, the finished product is cooled to an ambient bulk temperature. Preferably, this final cooling step is accomplished at least in part by forming the finished product into overlapping non-concentric rings on a moving conveyor, and by exposing the thus-formed rings to a gaseous coolant, typically air.

Experience to date indicates that the thermomechanical treatment of the semifinished product by sequential cooling, equalization, and finish rolling at a maximum bulk temperature of 1600° F will increase the yield strength to tensile strength ratio, with ratios in the range of 75% being possible. Such results may be achieved without altering the major portion of the rolling operation, it being sufficient to perform only the finish rolling operation at lower rolling temperatures. Thus, overall power requirements for the mill are not increased significantly.

Figure 2:
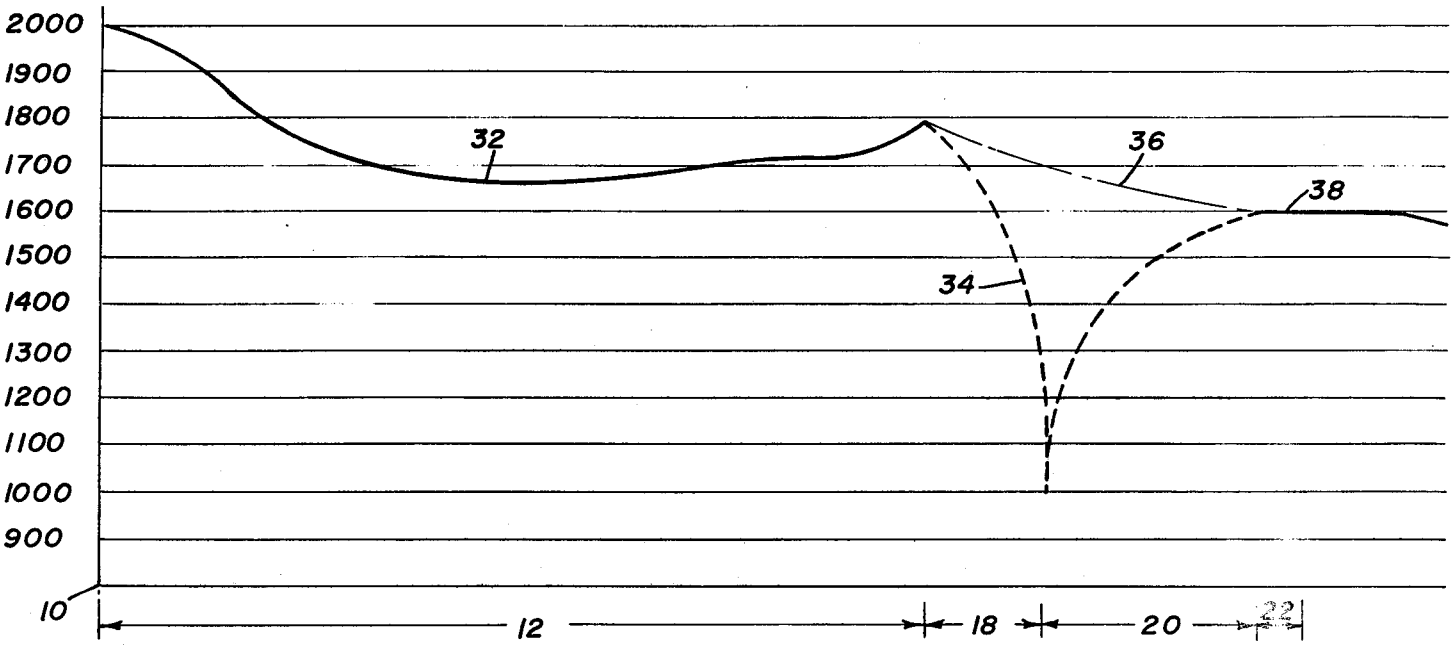
Figure 3:
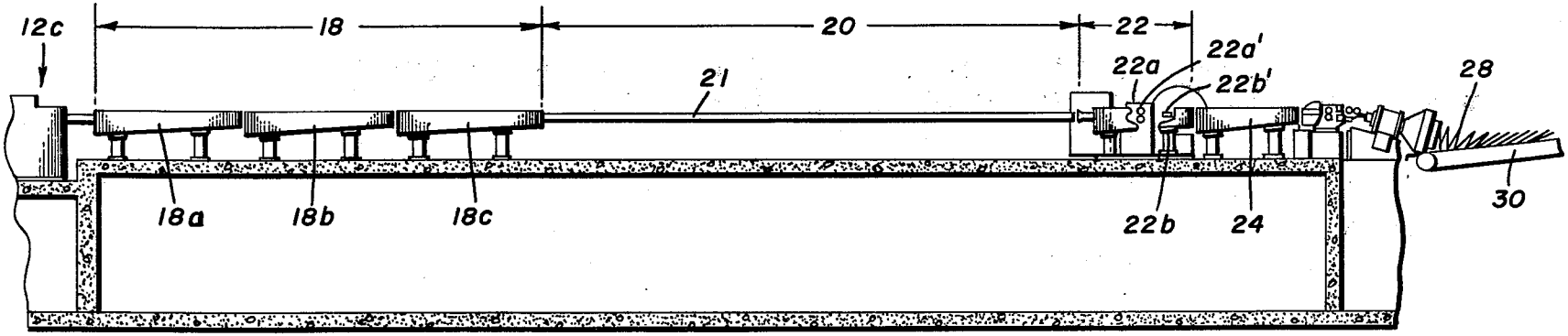

A preferred embodiment of the invention will now be described in greater detail with reference to the accompanying drawings, wherein:

FIG. 1 is a schematic plan view of a rolling mill layout adapted to practice the process of the present invention;

FIG. 2 is a graphic illustration of the temperature of the product as it progresses through the mill layout shown in FIG. 1. In this view, the heavy solid lines depict bulk temperatures, the dashed line depicts surface temperature, and the dot-dash line depicts the temperature of the center portion of the product; and, FIG. 3 is an enlarged side elevational view of the equipment outlined by dashed lines in FIG. 1.

Referring now to the drawings wherein like numbers designate like components throughout the several views, there is shown at 10 a furnace of the type conventionally employed in a rolling mill to reheat billets in preparation for a rolling operation. A rolling mill generally indicated at 12 and having roll stands grouped into mill sections **12*a*, 12*b* and 12*c* is arranged on the delivery side of the furnace 10. Mill section 12*c* may preferably comprise a block of closely spaced stands having alternately inclined overhung work rolls as described in U.S. Pat. No. RE 28,107. Conventional guide assemblies 14 and 16 are interposed on either side of mill section 12*b***.

In accordance with the process of the present invention, ferrous billets are heated in furnace 10 to an elevated bulk temperature preferably above 2000° F. As herein employed, the term "bulk temperature" is intended to designate an average cross-sectional temperature of the product. The thus heated billets are then extracted from the furnace by conventional means (not shown) and introduced into the mill 12 where they are rolled continuously by mill sections **12*a*, 12*b* and 12*c* into a semifinished product which emerges from mill section 12*c* at an intermediate bulk temperature approximately in the range of 1700° F to 1900° F. Preferably the semifinished product emerging from mill section 12*c*** has a round cross-section.

A cooling assembly 18 including multiple separately controlled sections **18*a*, 18*b* and 18*c* is arranged on the delivery side of mill section 12*c*. The separately controlled cooling sections preferably comprise water cooling boxes which apply a fluid coolant, for example water, to the surface of the semifinished product. The round cross-section of the semifinished product facilitates a uniform application of the coolant to the surface thereof. This cooling operation produces a drastic lowering of the surface temperature of the semifinished product to a level substantially below that of a desired maximum finish rolling temperature of approximately 1600° F. Thereafter, the semifinished product enters an elongated equalization zone 20 formed by guide pipes 21 leading to a finish rolling station 22. While passing through zone 22**, the temperatures of the center and surface portions of the semifinished product equalize substantially to the maximum finish rolling bulk temperature.

As is best shown in FIG. 3, the finish rolling station 22 preferably comprises at least two roll stands **22*a* and 22*b*. Preferably, each roll stand 22*a*, 22*b* has overhung rolls 22*a*′ and 22*b*′. Roll stand 22 imparts an oval cross-section to the product, which is finish rolled by roll stand 22*b*. If desired, the rolls 22*b*′ of roll stand 22*b*** may be adapted to deform the surface of the finished product when rolling concrete reinforcing bar.

After the finish rolling operation has been completed at station 22, the finished product is cooled to an ambient bulk temperature. Preferably, the major portion of this final cooling operation is accomplished by directing the finished product through another water cooling box 24 to a conventional inclined laying head 26 which forms the finished product into rings 28 which are deposited in an overlapping Spencerian pattern on a moving conveyor 30. While on the conveyor 30, the rings are cooled by being exposed to a flow of fluid coolant, for example ambient air.

FIG. 2 is a typical graphical representation of product temperature profiles for a ferrous billet 120 × 120 MM being rolled in accordance with the present invention to a bar 6.0 MM in diameter at a finish rolling speed of 50 meters/second. The billet is initially heated in furnace 10 to an elevated bulk temperature in excess of 2000° F. Thereafter, as the billet is rolled through mill 12, its bulk temperature (represented by heavy solid line 32) initially decreases to a level of approximately 1600° F in mill section **12*b* before gradually rising as a result of energy being imparted through rolling to approximately 1800° F as the semifinished product exits from mill section 12*c***.

At this point, the semifinished product enters cooling assembly 18 where it is subjected to a surface application of cooling water. The surface temperature of the semifinished product (represented by dashed line 34) is thus lowered to approximately 1000° F, while the temperature of the center portion (dot-dash line 36) drops gradually. Thereafter, as the thus cooled semifinished product progresses through equalization zone 20, the temperatures of its surface and center portions gradually equalize to a desired maximum finish rolling bulk temperature of approximately 1600° F (represented by line 38). The semifinished product is then finish-rolled at station 22 and thereafter cooled to an ambient bulk temperature. As previously indicated, the thermomechanical treatment of the semifinished product by (*a*) surface cooling at zone 18; (*b*) temperature equalization at zone 20; and (*c*) low temperature finish rolling at station 22 increases yield strength to tensile strength ratio, with ratios in the range of 75% being possible.

In light of the foregoing, it will now be appreciated by those skilled in the art that numerous modifications can be made to the procedures and apparatus described above without departing from the spirit and scope of the invention. For example, the type and arrangement of equipment making up mill 12 can be varied to suit particular rolling requirements. Likewise, the type and number of cooling sections in cooling zone 18 can be varied, as well as the type and number of roll stands at the finish rolling station 22. The level to which the surface temperature of the semifinished product is cooled, as well as the cooling rate, can also be varied to suit each rolling operation.

We claim:

1. A process for forming a ferrous billet into a finished product comprising the following steps in sequence:

a. heating the billet to an elevated bulk temperature;
b. hot rolling the heated billet in a rolling mill to produce a semifinished product having an intermediate bulk temperature below said elevated bulk temperature and above a desired finish rolling bulk temperature;
c. subjecting the semifinished product to a cooling operation to lower the surface temperature thereof to a level below said finish rolling bulk temperature;
d. allowing the temperatures of the surface and center portions of the semifinished product to equalize substantially to said desired finish rolling bulk temperature;
e. finish rolling the semifinished product to a finished product; and,
f. subjecting the finished product to further cooling to an ambient bulk temperature.

2. The process as claimed in claim 1 wherein said cooling operation comprises the application of a fluid coolant to the surface of the semifinished product.

3. The process as claimed in claim 2 wherein said fluid coolant is water.

4. The process as claimed in claim 1 wherein the semifinished product has a round cross-section.

5. The process as claimed in claim 4 wherein said finish rolling is accomplished by passing the semifinished product through at least two sets of work rolls, the first set of work rolls being operative to produce an oval cross-section which is rolled by the second set of work rolls into the finished product.

6. The process as claimed in claim 5 wherein the finished product is concrete reinforcing rod, and wherein said second set of work rolls is adapted to deform the surface of the finished product.

7. The process as claimed in claim 1 wherein the billet is heated initially to an elevated bulk temperature above 2000° F.

8. The process as claimed in claim 7 wherein the semifinished product has an intermediate bulk temperature approximately in the range of 1700° F to 1900° F immediately prior to being subjected to said cooling operation.

9. The process as claimed in claim 1 wherein said finish rolling bulk temperature is a maximum of 1600° F.

* * * * *